United States Patent [19]

Grootjans et al.

[11] Patent Number: 4,842,717

[45] Date of Patent: Jun. 27, 1989

[54] PROCESS FOR DEWAXING GAS OILS

[75] Inventors: Jacques F. Grootjans, Leefdaal; Pierre J. Bredael, Bruxelles, both of Belgium

[73] Assignee: Labofina, S.A., Brussels, Belgium

[21] Appl. No.: 7,954

[22] Filed: Jan. 28, 1987

[30] Foreign Application Priority Data

Jan. 28, 1986 [LU] Luxembourg ..... 86269

[51] Int. Cl.[4] ..... C10G 11/06

[52] U.S. Cl. ..... 208/118; 208/28; 208/87; 208/109

[58] Field of Search ..... 208/109, 118, 28, 87

[56] References Cited

U.S. PATENT DOCUMENTS

| | | | |
|---|---|---|---|
| 3,700,585 | 10/1972 | Chen et al. | 208/111 |
| 4,061,721 | 12/1977 | Strong | 423/272 |
| 4,061,724 | 12/1977 | Grose | 423/335 |
| 4,309,275 | 1/1982 | Mulaskey | 208/120 |
| 4,309,276 | 1/1982 | Miller | 208/120 |
| 4,361,477 | 11/1982 | Miller | 208/67 |
| 4,362,653 | 12/1982 | Robinson | 502/64 |
| 4,428,825 | 1/1984 | Ward et al. | 208/110 |
| 4,437,975 | 3/1984 | Gillespie et al. | 208/86 |
| 4,443,329 | 4/1984 | Eberly, Jr. et al. | 208/216 R |
| 4,447,313 | 5/1984 | Corring et al. | 208/86 |
| 4,490,570 | 12/1984 | Forward et al. | 585/467 |
| 4,548,705 | 10/1985 | Yamy et al. | 208/104 |
| 4,561,967 | 12/1985 | Miller | 208/61 |
| 4,579,989 | 4/1986 | Butler | 585/469 |
| 4,587,371 | 5/1986 | Forward et al. | 585/467 |
| 4,599,473 | 7/1986 | Debras et al. | 502/77 |
| 4,657,662 | 4/1987 | Valyocsik | 208/118 |

FOREIGN PATENT DOCUMENTS

| | | | |
|---|---|---|---|
| 82019 | 3/1986 | European Pat. Off. | 208/109 |

*Primary Examiner*—H. M. S. Sneed
*Assistant Examiner*—Helane Myers
*Attorney, Agent, or Firm*—Mark A. Montgomery; William D. Jackson; John K. Abokhair

[57] ABSTRACT

A process is disclosed for eliminating waxy paraffins from hydrocarbon feedstocks having an initial boiling temperature above about 180° C. and containing sulphur, by selective cracking of the straight chain paraffinic hydrocarbons, said process comprising passing said feedstock over a crystalline silica polymorph of the silicalite type under suitable operating conditions for cracking the straight chain paraffins.

15 Claims, No Drawings

PROCESS FOR DEWAXING GAS OILS

The present invention relates to a new process for dewaxing hydrocarbon feedstocks boiling in the gas oil range including light gas oils, heavy gas oils and gas oils used as precursors of lube oils. The invention also involves decreasing the cloud point of these hydrocarbon feedstocks. Particularly, the invention relates to processes which are tolerant of sulfur containing feedstocks.

Sulfur which is commonly encountered in hydrocarbon feedstocks often acts to adversely affect catalysts employed in hydrocarbon conversion reactions. Thus, it is a conventional practice in many refining operations to pretreat a hydrocarbon feedstock to reduce the sulfur content thereof to an acceptable level before carrying out a desired refining procedure. Some molecular sieve catalysts tolerate relatively large amounts of sulfur in the feedstreams for certain conversion reactions and some do not. Thus, U.S. Pat. No. 4,579,989 to Butler discloses the use of a silicalite catalyst in the conversion of olefinic feedstreams containing sulfur contaminants into higher molecular weight hydrocarbons. For example, Butler discloses the conversion of FCC offgas streams containing more than 6 mole percent hydrogen sulfide. The silicalite catalysts employed in Butler are unmodified and no special chemical, thermal or steam pretreatment of the as synthesized catalysts, is necessary prior to use. U.S. Pat. No. 4,587,371 to Forward et al discloses the use of silicalite as a catalyst in the alkylation of aromatic substrates in which sulfur contents of only a few ppm had normally been considered to be unacceptable.

In order to produce gas oils or lubricating oils, it often happens that waxy paraffinic hydrocarbons have to be removed from the liquid hydrocarbon feedstocks. More particularly, in the production of gas oils, the removal of these waxy hydrocarbons is necessary because their presence leads to unacceptably high cloud points, resulting in a reduction of the efficiency of these gas oils at low temperatures.

Processes for removing these waxy paraffins are known in the art. Generally, those processes involve treatment with a suitable solvent, but catalytic processes are also known to remove these paraffins.

U.S. Pat. No. 3,700,585 to Chen et al discloses a process for removing the waxy paraffins from hydrocarbon feedstocks in the presence of zeolites. These zeolites are crystalline aluminosilicates which have an ion exchange capacity. Specifically disclosed are ZSM-5 and ZSM-8 in the hydrogen form or with replacing metal cations. The treated feedstocks have a very low sulfur content.

European Pat. No. 82019 also discloses a process for selectively removing waxy paraffinic hydrocarbons by passing the hydrocarbon feed over a zeolite modified with an organic silane compound, and in the presence of hydrogen. The treated feedstocks also have a very low sulfur content.

In dewaxing procedures, silicalite catalysts which have been modified by the inclusion of metallic components to impart substantial hydrogenation activity to the catalysts, have been employed in the dewaxing of feedstocks containing substantial amounts of sulfur. For example, U.S. Pat. No. 4,443,329 to Eberly discloses hydroprocessing, said to include hydrodewaxing, of sulfur-contaminated feedstreams over silicalite catalysts composited with a support having a hydrogenation component associated therewith. Preferred catalysts include 2–30% Group VIB and 0.1–10 wt. % Group VIII metal components calculated as oxides. Thus, feedstocks containing from 2–5 wt. % sulfur were hydroconverted over silicalite catalysts containing from about 6–12 wt. % cobalt and molybdenum oxides.

U.S. Pat. No. 4,309,275 to Mulaskey discloses a catalytic dewaxing process with enhanced olefin production in which a paraffin containing feedstock is contacted with silicalite to produce an effluent of enhanced content. Mulaskey discloses conversion of a light vacuum gas oil having a sulfur content of about 2 wt. % over a silicalite catalyst modified by the inclusion of 3% cobalt, 7% nickel and 20% molybdenum.

While such modified silicalite catalysts are known to tolerate high sulfur levels, the prior art suggests that silicalite in substantially unmodified form will not tolerate substantial sulfur concentrations. That is, silicalite by itself tolerates only relatively small concentrations of sulfur. For example, U.S. Pat. No. 4,362,653 to Robinson discloses hydroprocessing over silicalite catalysts which may or may not be modified by the inclusion of an optional metal component. Here, the patentees teach that the feedstock should be treated to remove substantially all sulfurous contaminants. U.S. Pat. No. 4,428,825 to Ward et al discloses hydrodewaxing over a catalyst having Group VIB and Group VIII metal component on a silicalite support. The patentees suggest that the total sulfur content of the feed should be within the range of 50°–1000° ppm.

It is also known that dewaxing over usual catalysts of gas oils used as precursors of lube oils considerably lowers the viscosity index of said oils.

There is, therefore, a need for a process which enables the removal of waxy paraffins in a manner that the resulting dewaxed products can be efficiently used at low temperatures.

The object of the present invention is to provide an improved process for removing the waxy paraffins from hydrocarbon feedstocks having an initial boiling above about 180° C., and having a sulfur content of about 1% by weight or more.

Another object of the present invention is to provide a process for removing the waxy paraffins from light gas oils, heavy gas oils, vacuum gas oils, atmospheric gas oils, gas oils used as precursors of lube oils and deasphalted oils.

Another object of the present invention is to provide a process for removing the waxy paraffins from gas oil feedstocks in a manner which avoids excessive reduction of the cetane index of the gas oil.

Still another object of the present invention is to provide a process for dewaxing gas oils used as precursors of lube oils while keeping the viscosity index of said oils at a high level.

The present invention provides a process for removing waxy paraffins from hydrocarbon feedstocks boiling at initial temperatures above about 180° C. and containing sulfur in an amount of at least 1 wt. % by selectively cracking straight chain paraffinic hydrocarbons. The process comprises passing the hydrocarbon feedstock over an unmodified crystalline silica polymorph silicalite dewaxing catalyst under suitable operating conditions for cracking the straight chain paraffins.

Applicants have found that by passing a hydrocarbon feedstock boiling at initial temperatures of at least 180° C., particularly in the gas oil boiling range, whether light, heavy or coming from a vacuum distillation or from a deasphalted oil, and containing sulfur in an amount heretofore considered to be unacceptable to zeolite catalysts, over a crystalline silica polymorph of the silicalite type as catalyst, under operating conditions suitable for the cracking of paraffins, a product is obtained with a reduced content in paraffinic hydrocarbons, and having a lower pour point than that generally obtained in accordance with prior processes.

The cetane index is a very important factor to be considered in gas oils used in diesel engines. Indeed, if the cetane index goes down below a value of about 35, problems of starting of engines using such gas oils are encountered. This drawback may be overcome by adding various additives which make the starting of the engine easier. It is therefore of particular importance to maintain the cetane index at a value between about 40–50.

The catalyst used in the process of the invention is a crystalline silica polymorph of the silicalite type. Silicalite has no ion exchange capacity in comparison with aluminosilicates of the zeolite type which are silicates of aluminum and sodium and/or calcium. Aluminum may be present in silicalite, but in the form of impurity which comes from the silica source used to prepare the silicalite. It may be said that silicalites which contain this type of aluminum or other metal oxides as impurity, may not be considered as metallosilicates.

Silicaliate and its preparation are described in U.S. Pat. No. 4,061,721 to Grose et al, the entire disclosure of which is incorporated herein by reference.

In the dewaxing of gas oils, it is particularly advantageous to use silicalite having the following composition expressed as molar oxide ratios:

$$0.008\text{–}0.06\ M_2O{:}Al_2O_3{:}220\text{–}300\ SiO_2$$

wherein M is a cation selected from the alkali metal cations, normally sodium.

Although silicalite can be used alone as catalyst, it is most often mixed with a binder which is generally made of alumina. The binder normally comprises up to 20 wt. % of the mixture of silicalite and binder although greater amounts of binder may be present. The silicalite used in the present invention can be mixed with a binder. Thus the term "silicalite" as used herein encompasses silicalite in the form with a binder as well as the silicalite itself.

The silicalite catalyst employed in the present invention is in the unmodified form; that is, in the form as synthesized in accordance with the procedure disclosed in U.S. Pat. No. 4,061,724 to Grose, although as noted below the silicalite may be of either monoclinic or orthorhombic symmetry. The catalyst need not be chemically pretreated to increase its stability to sulfur contaminants, and it does not have a substantial hydrogenation component as disclosed in the aforementioned patents to Eberly and Mulaskey.

Silicalite in the as synthesized form and after calcining to decompose the alkyl ammonium templating agent employed in the synthesis procedure is in the orthorhombic form. However, as disclosed in U.S. Pat. No. 4,599,473 to Debras et al, silicalite of orthorhombic symmetry can be converted to monoclinic symmetry by calcining in air at a temperature of at least 600° C. for a period of 3 hours or more. Monoclinic silicalite has certain advantages in hydrocarbon conversion reactions as disclosed in the Debras et al patent. For a description of monoclinic silicalite, its preparation and use, reference is made to the aforementioned U.S. Pat. No. 4,599,473 to Debras et al, the entire disclosure which is incorporated herein by reference. The unmodified silicalite used in the present invention can, as noted above, be of orthorhombic or monoclinic symmetry.

An important distinction, which is employed to advantage in the present invention, lies in the tolerance of the unmodified silicalite catalyst to sulfur concentrations heretofore thought to be unacceptable at the conversion conditions employed in the dewaxing of gas oils.

In contrast to the low sulfur tolerance of the zeolite catalysts heretofore employed in the dewaxing of hydrocarbon feedstocks, the silicalite catalyst employed in the present invention permit the use of gas oil feedstocks having sulfur contamination levels higher than those heretofore considered to be acceptable since feedstocks having in excess of 1 wt. % sulfur may be treated. This offers an important commercial advantage since it increases the availability of hydrocarbon feedstocks for the conversion process. Experimental work described in greater detail hereinafter indicates that a sulfur contamination up to about 5 wt. % is readily tolerated and a preferred application of the invention is in the deaxing of deasphalted oil or light gas oils containing sulfur in an amount greater than about 1% by weight.

A further advantage of the present invention resides in the fact that a steam cofeed may be employed, notwithstanding that the feedstream to the reaction zone contains sulfur in amounts above what has been heretofore considered to be acceptable. In fact, it is believed that an effective amount of steam in the cofeed actually reduces coking, and therefore, increases the useful life of the catalyst.

The process of the invention for removing the waxy paraffins from hydrocarbon feedstocks boiling at initial temperatures above about 180° C. including the various types of vacuum gas oils and deasphalted oils, may be carried out in any suitable apparatus which comprises a reaction zone which contains the silicalite catalyst. The silicalite catalyst may be introduced in the reaction zone either in the form of a single bed or in the form of a multiple bed. On both sides of the catalytic beds, there may be provided layers of inert materials. Generally, the silicalite-containing reactor will be preceded or followed by one or more reactors for classical hydrotreatment of the hydrocarbon feedstocks. More particularly, the silicalite-containing reactor will precede the hydrotreatment reactor in order that the olefins formed under the reaction be submitted thereafter to a saturation reaction.

A preferred catalyst for use in the dewaxing of the hydrocarbon feedstocks in accordance with the present invention is a silicalite having a crystallite size of less than 8 microns and a ratio silica to alumina in the tetrahedra molecular network of at least 200.

More particularly, it is preferred to use a silicalite having the following composition expressed as molar oxide ratios:

$$0.008\text{–}0.06\ Na_2O{:}Al_2O_3{:}220\text{–}300\ SiO_2$$

A particular application of the invention is in the treatment of hydrocarbon feedstock fractions within the 180°–650° C. boiling point range.

Among the gas oil feeds which may be treated in accordance with the process of the invention, the light gas oils may be used. The light gas oils have boiling points between about 180° C.–320° C. They are obtained by atmospheric distillation. Another straight-run cut also obtained by atmospheric distillation may also be treated. These cuts give the heavy gas oils, which have a boiling point range of about 320° C.–375° C. Besides the cuts of the atmospheric distillation, the invention may also be used to treat the vacuum gas oils which result from fractions obtained by vacuum distillation. These vacuum gas oils have boiling point ranges between 370° C.–530° C.

In addition, deasphalted oils may also be dewaxed by the process of the invention. The deasphalted oils are obtained by extraction of the 530° C. residue using propane, butane, pentane, or mixtures thereof.

In accordance with the process of the invention, the feed is passed in the reaction zone containing the silicalite catalyst at a temperature between about 350° C.–450° C. and preferably between about 380° C.–420° C. The feed is passed under a pressure conditions ranging from atmospheric pressure up to about 80 bars, and preferably between about 35–60 bars, and at a liquid hourly space velocity (LHSV) between about 0.1–20, preferably between 0.5–5 $hr^{-1}$. Simultaneously with the feed, hydrogen is introduced into the reaction zone in such an amount such that the $H_2$/HC (hydrocarbons) ratio is between about 50–5,000 L/L and preferably between about 50–500 L/L (the hydrogen volume being measured in the gaseous state and under standard conditions i.e. in standard liters). Practically, however, only a small fraction of the hydrogen reacts, and the gas recovered at the reactor outlet, comprising hydrogen and a small amount of gaseous hydrocarbons, is generally recycled. To compensate for the hydrogen consumption, a fraction of the recycled gas is continuously replaced by fresh hydrogen.

The process of the invention is versatile, and may be used to treat deasphalted oils or gas oils used as precursors of lube oils which have previously been hydrocracked in order to improve their viscosity index and remove the aromatics. The process of the invention also provides for the viscosity index obtained by hydrocracking to be at a high level, thus producing lube oils having a good viscosity index and an excellent cloud point.

The following examples are given in order to better illustrate the process of the invention, but without limiting its scope.

EXAMPLE 1

A feed containing light gas oil, having the characteristics indicated in Table 1, was treated.

TABLE 1

| | |
|---|---|
| $d_{15/4}$ | 0.852 |
| distillation: wt % | IBP - 180° C.: 2.5% |
| | 180–350° C.: 94.5% |
| | 350+° C.: 3.0% |
| n-paraffin content | 43% by wt. |
| sulfur | 0.903% by wt. |
| Pour point | −3° C. |
| Viscosity at 50° C. (cSt) | 2.9 |
| Cetane Index | 50 |

The feed was passed in a reactor which contained a bed of silicalite catalyst disposed between two layers of inert materials. Simultaneously, hydrogen was introduced into the reactor. It was used in an amount such that the $H_2$/HC ratio was 360 SL/L (standard liters/liter).

The composition of the silicalite expressed as molar oxide ratio was: 0.048 $Na_2O$:$Al_2O_3$:280 $SiO_2$.

The feed was passed at different temperatures, pressures, and LHSV as indicated in Table 2. The results obtained are also indicated in Table 2.

TABLE 2

| | LHSV 0.8 | | | LHSV 1 | | |
|---|---|---|---|---|---|---|
| Temperature | 380 | 400 | 420 | 380 | 400 | 420 |
| Sulfur (wt %) | 1.118 | 1.030 | 0.949 | 1.095 | 1.040 | 0.964 |
| n-paraffin (% by wt) | 13 | 19 | 26 | 14 | 19 | 22 |
| Cloud point (°C.) | <−51° C. | | | <−51° C. | | |
| Pour Point (°C.) | <−51° C. | | | <−51° C. | | |
| Viscosity at 50° C. (cSt) | 3.23 | 3.22 | 3.14 | 3.30 | 3.13 | 3.14 |
| Specific gravity ($d_{15/4}$) | 0.880 | 0.879 | 0.880 | 0.877 | 0.878 | 0.879 |
| Cetane Index | 43 | 43 | 43 | 44 | 43 | 43 |

EXAMPLE 2

A feed which contained light gas oils, and having the characteristics indicated in Table 3, was treated.

TABLE 3

| Feed Properties | |
|---|---|
| Specific gravity ($d_{15/4}$) | 0.852 |
| Cetane index | 50.2 |
| Cloud point | −5° C. |
| Pour point | −9° C. |
| % volume distilled at 350° C. | 97% |
| n-paraffin content | 34% |
| sulfur content | 0.9% |

The feed was passed into a reactor which contained a bed of silicalite catalyst disposed between two layers of an inert material. The operating conditions were the following:

Temperature: 360° C.
LHSV: 4
$H_2$/HC: 360 NL/L
Pressure: 40 bars
Silicalite composition: 0.048 $Na_2O$:$Al_2O_3$:280 $SiO_2$.

The results obtained are indicated in Table 4.

TABLE 4

| | |
|---|---|
| Distillation (wt %) | |
| gas | 0.2 |
| $C_3 + C_4$ | 9.3 |
| $C_5$ − 180° C. | 11.7 |
| 180° C.+ | 78.8 |
| Properties of the 180° C.+Cut | |
| $d_{15/4}$ | 0.863 |
| Distillation vol % at 250° C. | 10% |
| 350° C. | >90% |
| Pour point | −39° C. |
| Cloud point | −32° C. |
| Cetane index | 46.1 |
| Properties of the $C_5$- 180° C. Cut | |
| PONA (Paraffins | 25% by weight |
| Olefins | 56% by weight |
| Naphtenes | 7% by weight |
| Aromatics) | 5% by weight |
| RON | 86 |
| MON | 74.8 |

EXAMPLE 3

A feed containing a heavy gas oil, which resulted of atmospheric distillation, was treated. The heavy gas oil has a boiling point generally comprised between 320° C.–375° C. The characteristics of the heavy gas oil are indicated in Table 5.

TABLE 5

| Properties of the Feed | | |
|---|---|---|
| $d_{15/4}$ | | 0.882 |
| Distillation | IBP - 180° C. | 0.6% by wt |
| | 180° C.-350° C. | 32.1% by wt |
| | 350° C.+ | 67.3% by wt |
| n-paraffin | | 25.4% |
| sulfur content | 0.9% | |
| Fraction | 180° C.-350° C. | 350° C.+ |
| Pour point | −12° C. | 24° C. |
| Cloud point | −9° C. | — |
| Cetane index | 48.8 | 46.9 |

This feed was passed to a reactor containing a bed of silicalite catalyst disposed between two layers of inert material. The operating conditions were the following:

Pressure: 35 bars $H_2$/HC: 300 SL/L

LHSV: 2, 4, 6

Silicalite composition: 0.027 $Na_2O$:$Al_2O_3$:250 $SiO_2$.

The results obtained are indicated in Table 6.

TABLE 6

| Temerature (°C.) | 350 | | 380 | | |
|---|---|---|---|---|---|
| LHSV | 2 | 6 | 2 | 4 | 6 |
| Properties of the 180-350° C. fraction | | | | | |
| $d_{15/4}$ | 0.876 | 0.866 | 0.881 | 0.879 | 0.871 |
| Pour point (°C.) | −21 | −9 | <−50 | −36 | −21 |
| Cloud point (°C.) | −17 | −11 | <−50 | −28 | −19 |
| Cetane index | 46.3 | 48.8 | 44.8 | 46 | 47.5 |
| Properties of the 350+° C. fraction | | | | | |
| $d_{15/4}$ | 0.906 | 0.893 | 0.921 | 0.914 | 0.902 |
| Pour point (°C.) | 12 | 18.3 | −33 | −6 | 9 |
| Cloud point (°C.) | 13 | 21.1 | — | 2 | 11 |
| Cetane index | 45 | 47 | 40 | 43 | 45.5 |
| Total liquid effluent properties | | | | | |
| n-Paraffin (% by wt) | 14.8 | 19.9 | 6.8 | 12.6 | 15.0 |

EXAMPLE 4

A feed constituted of a vacuum gas oil was treated. The vacuum gas oils have generally a boiling point ranging between 370° C.-530° C., and are obtained by vacuum distillation. The properties of the feed are indicated in Table 7.

TABLE 7

| Average feed properties Boiling point range (°C.) | IBP-180 | 180-250 | 250-370 | 370-500 | | 500+ | Total Feed |
|---|---|---|---|---|---|---|---|
| Yield (% wt) | 0.1 | 2.55 | 18.39 | 64.55 | | 14.41 | 100 |
| $d_{15/4}$ | — | 0.831 | 0.886 | | 0.9179 | | 0.91 |
| S (% wt) | 0.05 | 0.646 | 1.330 | 1.435 | | 1.680 | 1.42 |
| | | | | | (1.476) | | |
| N total (ppm) | — | 16 | 200 | | 1,220 | | 1010 |
| N basic (ppm) | — | 6 | 65 | | 321 | | 267 |
| Carbon conradson (% wt) | | | | | 0.42 | | |
| Viscosity at 100 C | | | | | 7.62 | | |
| Viscosity at 120 C (c Stokes) | | | | | 4.87 | | |
| Refractive index | | | | | 1.488 | | |
| Aniline point (C) | | | | | 86.6 | | |
| Bromine number | | | | | | | 4 |
| Cetane index | | | 44.8 | | | | |
| Pour point °C. | | | 0 | | | | |
| Cloud point °C. | | | −2 | | | | |

The feed was passed into a reactor containing a bed of silicalite catalyst disposed between two layers of inert material. The operating conditions were the following:

Pressure: 54 bars

Temperature: 405° C.

LHSV: 3

The dewaxed feed has the following composition and properties:

Composition

Fuel gas 1%

$C_3+C_4$ 2.0%

$C_5$-180° C. 3.2%

180° C.-250° C. 2.3%

250° C.-370° C. 17.8%

370+° C. 73.7%

| Properties | | | | | |
|---|---|---|---|---|---|
| Fraction | $d_{15/4}$ | Aniline Pt. | Pour Pt. | Cloud Pt. | Refract. Index (80° C.) |
| 180° C.-250° C. | 0.838 | — | — | — | — |
| 250° C.-370° C. | 0.903 | 54.4 | −27° C. | −24° C. | — |
| 370° C.+ | 0.93 | 87.2 | 5° C. | 7° C. | 1.496 |

This table shows a reduction of the pour point and cloud point, together with a reduction of the aniline point. and an increase of the refractive index. These circumstances indicate a significant reduction of the n-paraffin content of the feed.

EXAMPLE 5

A feed constituted of a deasphalted oil was treated. The deasphalted oil was obtained by butane extraction of the vacuum distillation residue at 530° C. The properties of the feed are indicated in Table 8.

TABLE 8

| | |
|---|---|
| Density $d_{15/4}$ | 0.9245 |
| Distillation: | |
| IBP - 370° C. | 2% |
| 370° C.+ | 98% |
| Sulphur | 3.64 wt. % |
| Total nitrogen | 560 ppm |
| Basic nitrogen | 170 ppm |
| Carbon Conradson | 1.37 wt % |
| Viscosity | |
| at 100° C. | 18.88 cSt |
| at 120° C. | 9.76 cSt |
| Aniline point | |
| 350-540° C. | 87° C. |
| 540° C.+ | 106° C. |
| Pour point | higher than 43° C. |

This feed was passed to a reactor containing a bed of silicalite between two layers of inert material. The operating conditions were the following:

Pressure: 60 bars
Temperature: 390° C.
LHSV: 1
$H_2$/HC volume ratio: 100 SL/L
Siliclite composition: 0.027 $Na_2O:Al_2O_3$:250 $SiO_2$.

The dewaxed feed had the following composition and properties:

Composition (wt %)
$C_1$-$C_2$: 1.03
$C_3$: 4.37
$C_4$: 2.72
IBP–180° C.: 4.29
180°–350° C.: 3.15
350°–540° C.: 51.23
540° C.+: 33.21
Properties of the 350°–540° C. fraction
Viscosity index: 60
Pour point: 6° C.
Aniline oint: 83.2° C.
Properties of the 540° C.+fraction
Viscosity index: 75
Pour point: 6° C.
Carbon Conradson: 4.33 wt %

These results show a reduction of the aniline point and a considerable reduction of the pour point, both indicating a significant reduction of the n-paraffin content of the feed.

Moreover, it is worth noting that the sulfur content of the feed is high, and that some fractions of said feed had a sulphur content of 4.1 wt %. Even at such high sulfur values no catalyst deactivation was observed.

EXAMPLE 6

A feed constituted of a gas oil used as precursor of lube oils was treated, the properties of which are indicated in Table 9.

TABLE 9

| | |
|---|---|
| Density $d_{15/4}$ | 0.916 |
| Distillation: 350–470° C. | 100% |
| Pour point | +27° C. |
| Aniline point | +77.2° C. |
| VI (viscosity index) | 67 |

The feed was first submitted to hydrocracking at 380° C., under a pressure of 120 bars, at a LHSV of 0.6 and in the presence of hydrotreatment catalyst constituted of nickel and molybdenum on alumina.

The hydrotreated feedstock had a pour point of +24° C. and a VI of 151. It was then passed to a reactor containing a bed of silicalite catalyst between two layers of inert material. The operating conditions were the following:

Pressure: 54 bars
Temperature: 370° C.
LHSV: 1
$H_2$/HC: 274 SL/L
Silicalite composition: 0.008 $Na_2O:Al_2O_3$:280 $SiO_2$.

The resulting product had a pour point of −18° C. and a VI of 100.

This example clearly shows that the process of the invention enables the production of a lube oil having a good pour point while retaining an excellent VI.

EXAMPLE 7

A heavy gas oil having the following properties was treated:

density $^d14/4$: 0.9339
distillation : 470+° C.: 100%
pour point: 48° C.
analine point: 111° C.
Carbon Conradson: 3.87 wt %

This feed was first submitted to hydrocracking at a temperature of 410° C., under a pressure of 120 bars, at a LHSV of 0.3 and in the presence of a hydrotreatment catalyst found of nickel and molybdenum on alumina.

The hydrotreated feedstock had a density ($^d15/4$) of 0.8721, a pour point of 48° C. and an aniline point of 133° C. The hydrotreated feedstock was passed in a reactor containing a bed of silicalite between two layers of inert material, under the following conditions:

pressure: 54 bars
temperature: 350° C.
LHSV: 0.6

The resulting product had the following properties:

density $^d15/4$: 0.8736
pour point: 2° C.
VI: 70

We claim:

1. A process for removing waxy paraffins from hydrocarbon feedstock having an initial boiling point of at least 180° C. and containing sulfur in an amount of at least 1% by weight by selective cracking of straight chain paraffinic hydrocarbons comprising passing said hydrocarbon feedstock over an unmodified crystalline silica polymorph silicalite dewaxing catalyst under suitable operating conditions for cracking the straight chain paraffins.

2. The process of claim 1 wherein said feedstock has a boiling point range within the range of 180°–650° C.

3. The process of claim 1 wherein said feedstock contains sulphur in an amount within the range of 1–5% by weight.

4. The process of claim 1 wherein said silicalite composition expressed as molar oxide ratio of 0.008–0.06 $M_2O:Al_2O_3$:220–300 $SiO_2$ wherein M is a cation selected from an alkali metal cation.

5. The process of claim 4 wherein said feedstock contains sulphur in an amount within the range of 1–5% by weight.

6. The process of claim 1 wherein the hydrocarbon feedstock is a light gas oil fraction boiling within the range of 180° C. and 320° C.

7. The process of claim 1 wherein the hydrocarbon feedstock is a heavy gas oil fraction boiling within the range of 320° C. and 375° C.

8. The process of claim 1 wherein the hydrocarbon feedstock is a vacuum gas oil fraction boiling within the range of 370° C. and 530° C.

9. The process of claim 1 wherein the hydrocarbon feedstock is a deasphalted oil.

10. The process of claim 1 wherein the hydrocarbon feedstock is passed over said catalyst at a temperature within the range of 350° C.–450° C., a pressure within the range of atmospheric pressure and 80 bars and a liquid hourly space velocity (LHSV) within the range of 0.1–20 $hrs^{-1}$.

11. The process of claim 10 wherein the hydrocarbon feedstock is passed over said catalyst at a temperature within the range of 380° C.–420° C.

12. The process of claim 10 wherein the hydrocarbon feedstock is passed over said catalyst at a pressure within the range of 35–60 bars.

13. The process of claim 10 wherein the hydrocarbon feedstock is passed over said catalyst at a liquid hourly space velocity (LHSV) within the range of 0.5–5 $hrs^{-1}$.

14. The process of claim 10 further comprising the step of passing hydrogen over said catalyst along with the hydrocarbon feedstock to provide a hydrogen/hydrocarbon volume in an amount ratio within the range of 50–5,000 standard liters/liter.

15. The process of claim 14 wherein the hydrogen/-hydrocarbon ratio is within the range 50–500 standard liters/liter.

* * * * *